US007434418B2

(12) United States Patent
Schock

(10) Patent No.: US 7,434,418 B2
(45) Date of Patent: Oct. 14, 2008

(54) COLD FOG GENERATOR AND/OR NATURAL SMOKE/FOG DISTRIBUTION SYSTEM

(76) Inventor: William Schock, 3385 Orcutt Rd., Santa Maria, CA (US) 93455

( * ) Notice: Subject to any disclaimer, the term of this patent is extended or adjusted under 35 U.S.C. 154(b) by 137 days.

(21) Appl. No.: 11/182,583

(22) Filed: Jul. 14, 2005

(65) Prior Publication Data

US 2007/0012063 A1 Jan. 18, 2007

(51) Int. Cl.
*F25D 3/02* (2006.01)

(52) U.S. Cl. ..... 62/425; 62/327; 62/387

(58) Field of Classification Search ..... 62/425, 62/259.327, 448, 421
See application file for complete search history.

(56) References Cited

U.S. PATENT DOCUMENTS 4,512,515 A * 4/1985 Tenney ..... 239/129
4,818,843 A * 4/1989 Swiatosz ..... 392/397
5,156,333 A * 10/1992 Worsfold ..... 239/2.1
5,711,481 A * 1/1998 MacDonald et al. ..... 239/2.1
5,957,382 A * 9/1999 Thomas ..... 239/135

* cited by examiner

*Primary Examiner*—Melvin Jones
(74) *Attorney, Agent, or Firm*—Andrew Y. Schroeder, Esq.

(57) ABSTRACT

A cold fog generator and/or natural smoke/fog distribution system comprising a semi-sealed expansion chamber with three orifices, an exhaust duct, an ice tray, an inlet orifice, a support apparatus, ice, a smoke producing means, said exhaust duct located within said semi sealed expansion chamber, said exhaust duct being affixed to said orifice on lower portion of said semi sealed expansion chamber, said exhaust duct extending from said orifice up to and above said support apparatus, said ice tray, and said ice, said ice tray being supported by said support apparatus, and said ice being supported by said ice tray.

17 Claims, 11 Drawing Sheets

COLD FOG GENERATOR AND/OR NATURAL SMOKE/FOG DISTRIBUTION SYSTEM

CROSS-REFERENCE TO RELATED APPLICATIONS

Natural Smoke/Fog Distribution System; A One Way Venturi For Use With A Cold Fog Generator And/Or Natural Smoke/Fog Distribution System

FIELD OF THE INVENTION

The present invention is in the area of smoke machines and pertains more particularly to methods, apparatus, and systems for generating fog, flash freezing smoke and disbursing both to a remote location.

BACKGROUND OF THE INVENTION

Many entertainment events and other uses for smoke call for a heavy, thick, and low-lying fog effect. In order to produce a low-lying fog effect from a fluid smoke machine which will roll low over the ground, the smoke must be cooled significantly. If the hot smoke is not cooled significantly, it will rise, spread and dissipate. However, since smoke producing machines produce smoke at around 165°-200°, it quickly rises and dissipates if left unchanged.

Therefore, what is clearly needed in the art is a system, apparatus, and methods thereof for producing a low-lying fog effect which is cooled such that the fog and/or smoke will remain low over the ground and will not quickly rise and dissipate.

SUMMARY OF THE INVENTION

A cold fog generator and/or a fog and smoke distribution system comprising:

an expansion chamber with three orifices, an exhaust duct, a one way venturi or open inlet, a water drain, an ice tray, a support apparatus, ice, a fog producing means, said exhaust duct being affixed to said orifice on lower portion of said expansion chamber, said exhaust duct extending from said orifice up to and above said support apparatus, said ice tray, and said ice or dry ice, said ice tray being supported by said support apparatus, and said ice being supported by said ice tray, said water drain tubing located outside of said sealed expansion chamber and being connected with one of said orifices, said fog producing means connected to said expansion chamber through said one-way venturi or open inlet, said one-way venturi or open inlet being connected with said sealed expansion chamber through one of said orifices.

In some preferred embodiments the exhaust duct is made of PVC material. In other preferred embodiments, said exhaust duct is made of metal. In some preferred embodiments the ice tray is made of metal. In other preferred embodiments the ice tray is made of plastic.

In some preferred embodiments the support apparatus is comprised of four vertically placed support members spaced equidistantly from each other and connected with four horizontal members, said four horizontal members being connected to each other in the center.

In some preferred embodiments the support apparatus is made of PVC, or metal. In some preferred embodiments the sealed expansion chamber is made of plastic or metal.

In some preferred embodiments the one way venturi is affixed to said fog or smoke producing means via complimentary threading on both said fog producing means and on said one way venturi. In some preferred embodiments said smoke or fog producing means may be aimed at said inlet orifice when said one way venturi is not used. In some preferred embodiments the ice tray is made of metal or wire netting.

BRIEF DESCRIPTION OF THE DRAWING FIGURES

DESCRIPTION OF PREFERRED EMBODIMENTS

According to a preferred embodiment of the present invention, a unique system, method, and apparatus is used to deliver a cold and low-lying fog effect. The present invention is described in enabling detail below.

Figure 1:
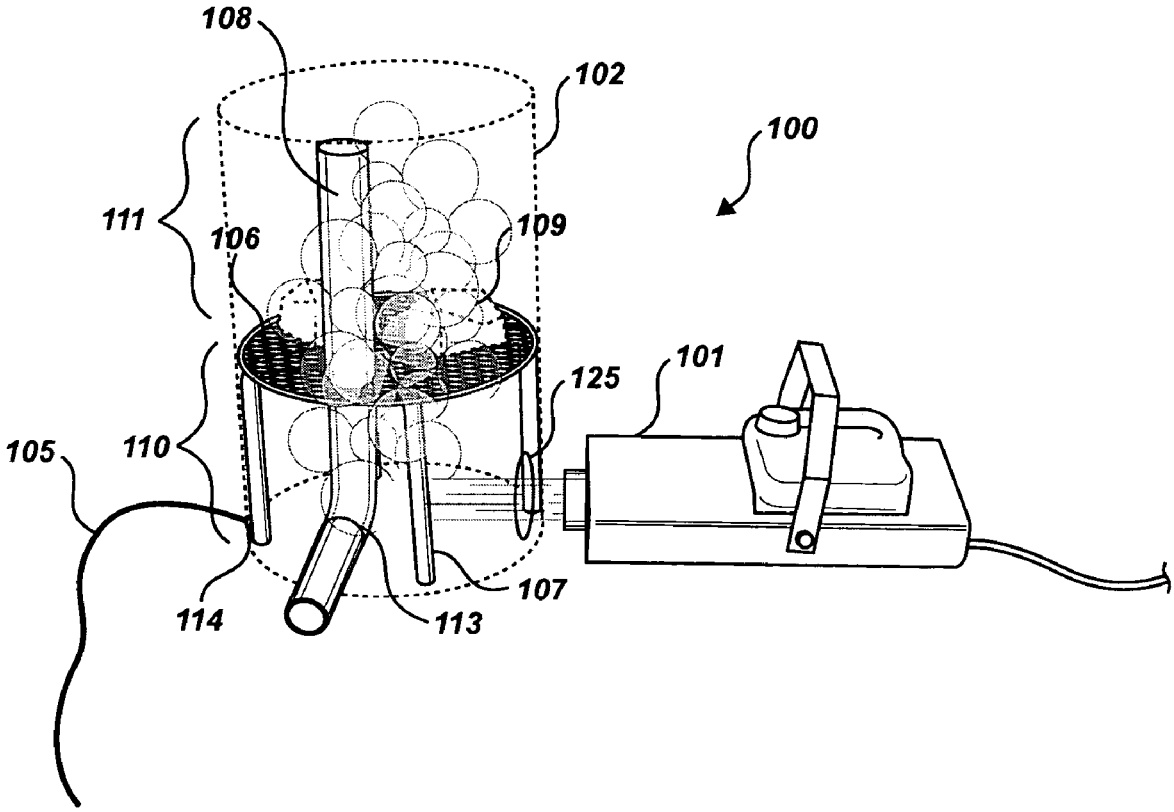
FIG. 1 is an isometric view of a preferred embodiment of the present invention.
Figure 2:
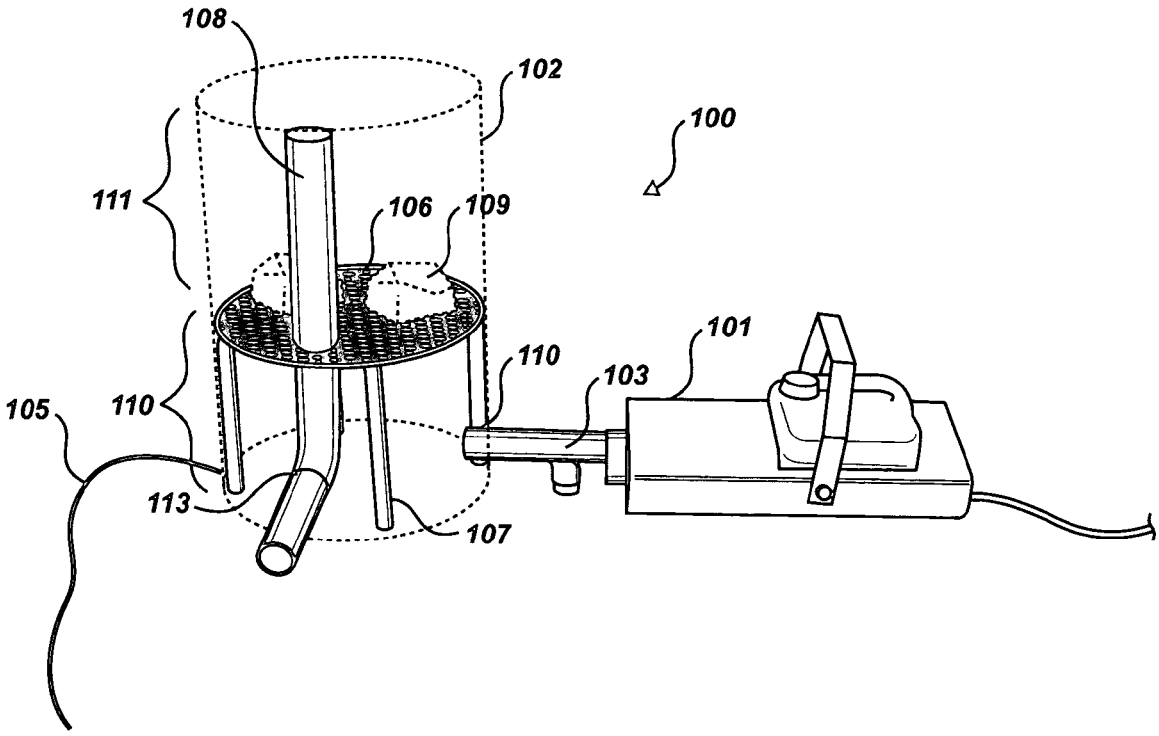
FIG. 2 is an isometric view of a preferred embodiment of the present invention.
Figure 11:
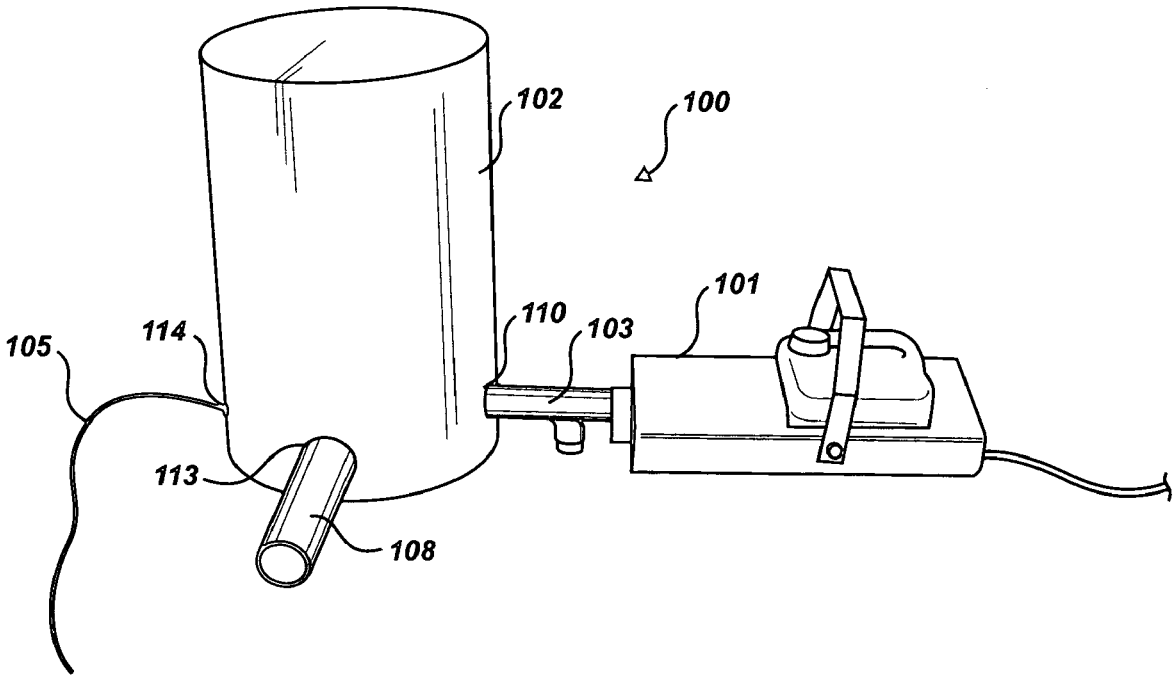
FIG. 11 is an isometric view of a preferred embodiment of the present invention.

FIG. 1 is a perspective view of a preferred embodiment of the present invention. Cold fog generator and smoke/fog distribution system 100 (hereafter cfgnsfds) comprises a smoke machine 101, a chamber 102, an inlet orifice 125, (or in some preferred embodiments a one-way venturi 103 as illustrated in FIG. 11), and tubing 105. FIG. 2 illustrates the remaining elements: an ice tray 106, support apparatus 107, exhaust duct 108, ice 109, expansion chamber 110 and flash freeze chamber 111.

It should be pointed out here that cfgnsfds 100 in some preferred embodiments is a sealed system. In other preferred embodiments, cfgnsfds 100 is a semi-sealed system. Although cfgnsfds 100 possesses orifices, it is to be understood that the mentioning of these orifices is for the purpose of fabrication of the present invention. System relies on the friction that is created by the inletting of fog into expansion chamber to push fog through opposing orifice to the inlet.

It should also be pointed out that the venturi apparatus is optional. In FIG. 1, embodiment #1 no venturi apparatus 103 is used. FIG. 2 illustrates another preferred embodiment where a venturi apparatus 103 is used. Either embodiment may accomplish the desired objectives.

Ice 109 is used for the purpose of cooling the smoke thereby enabling a low-lying fog-effect. In some preferred embodiments, ice 109 may be either regular ice or dry ice. For the purposes of clarity, the term ice 109 shall refer to both regular ice or dry ice.

Chamber 102 is a container with three orifices 125, 113, and. Inlet orifice 125 is where the smoke is directed through. Orifice 114 is where melting ice water drains from the chamber 102. And orifice 113 is where fog exits from cfgnsfds 100.

Inside the chamber 102 is the exhaust duct 108. Exhaust duct 108 passes through wall of chamber 102 through orifice 113. From the point of attachment, exhaust duct 108 has a length such that it traverses the height of both support apparatus 107 and ice tray 106. Exhaust duct 108 in a preferred embodiment is made of a garden-variety PVC piping material. However other materials and pipes may be equally expedient to constitute the exhaust duct 108. Therefore, the specific material and apparatus used to constitute the exhaust duct 108 is of no consequence.

Smoke machine 101 is the apparatus which produces the smoke. There abound many different types of smoke machines with which cfgnsfds 100 may be adapted to work. In other preferred embodiments, smoke machine 101 is attached to the one-way venturi 103. In turn, the one-way venturi 103 is attached to orifice 110 of expansion chamber 102. And in some preferred embodiments such as what is illustrated in FIG. 1, smoke machine 101 is simply pointed towards inlet orifice 125 in order to introduce smoke into the cfgnsfds 100.

In a preferred embodiment, inlet orifice 125 is the point where smoke is introduced into cfgnsfds 100. Inlet orifice 125 is placed near smoke machine 101 such that most of the smoke will be introduced into cfgnsfds 100. This distance may be anywhere between 1 inch to several inches.

Figure 5:
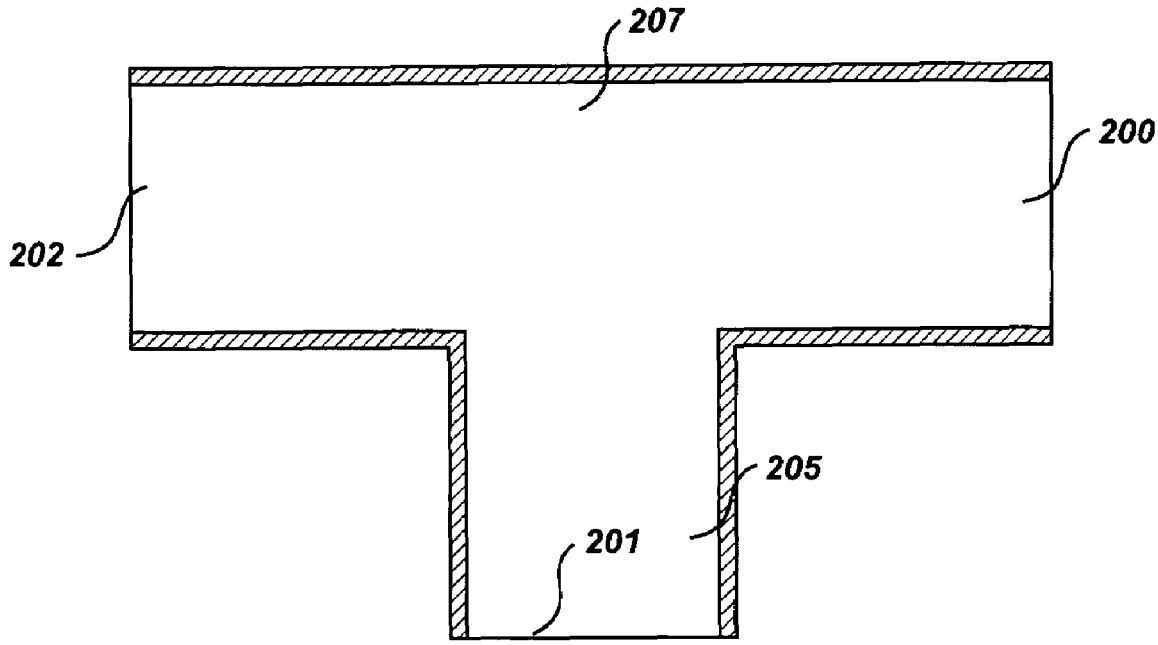
FIG. 5 is an isometric view of a preferred embodiment of the present invention.
Figure 6:
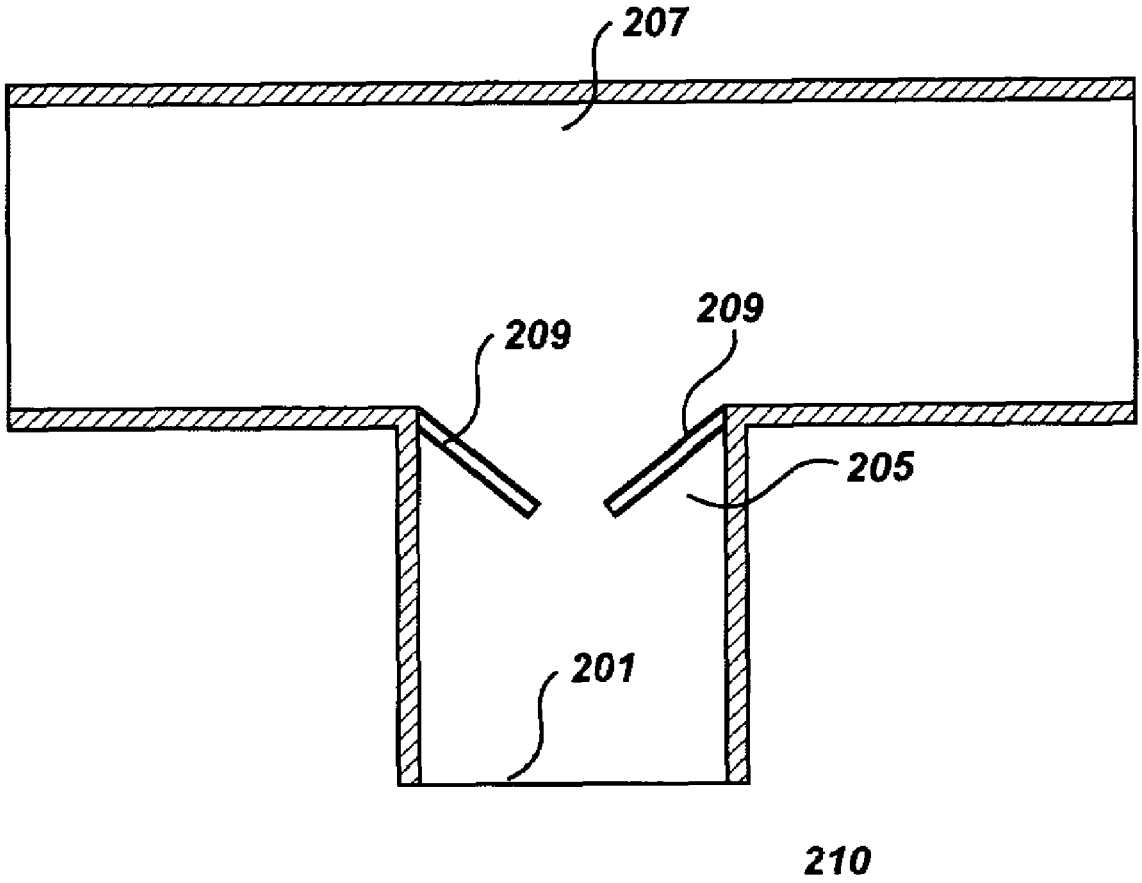
FIG. 6 is an isometric view of a preferred embodiment of the present invention.
Figure 7:
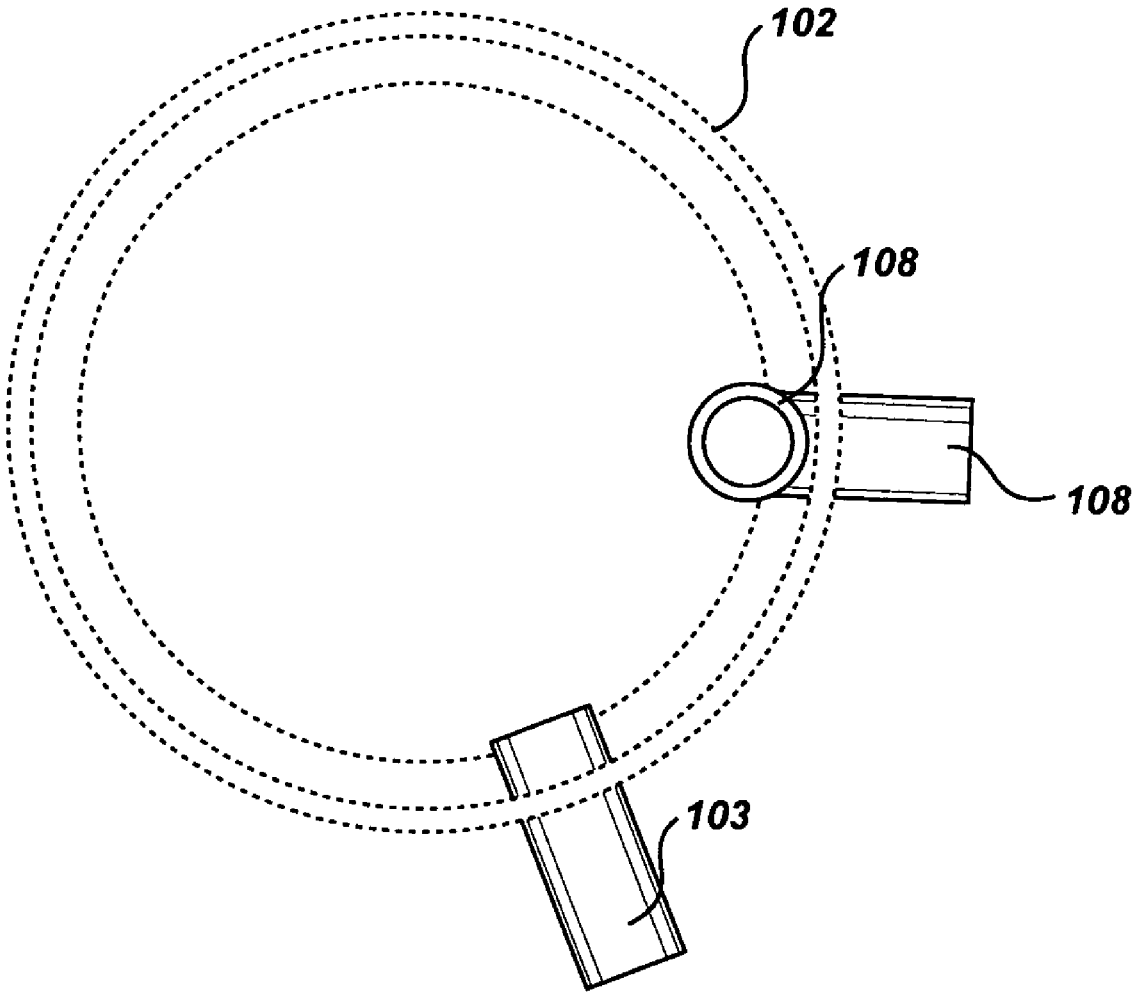
FIG. 7 is an isometric view of a preferred embodiment of the present invention.

As discussed above, the use of a one way venturi 103 is optional in some preferred embodiments. One-way venturi 103 is the one-way conduit by which smoke machine 101 may deliver smoke into the chamber 102. As seen in FIGS. 5 and 6, one way venturi 103 possesses three orifices, 200, 201, and 202. Orifice 200 attaches to the smoke machine 101. Orifice 202 attaches to orifice 110 of the expansion chamber 102 via the one way venturi 103. Orifice 201 is the conduit for outside air to flow into chamber 102. Orifice 201 is also the entry point to gate chamber 205. Gate chamber 205 is where air flow is impeded using various means.

In preferred embodiments, the function of shutting down smoke flow from gate chamber 205 is accomplished through gate means 209, a trap door means, a spring means, reeds etc. A skilled artisan within the art will be able to enable a spring means, trap door means, or other means of shutting down air flow from expansion chamber 102. Therefore, the specific details shall not be detailed herein.

In order to attach the one-way venturi 103 to expansion chamber via orifice 110 both orifice 110 and one-way venturi 103 may be complimentarily threaded and sized to fit each other. However, it is not specifically required that the mode of attachment is via threading. Other modes of attachment such as gluing, soldering, etc. are equally expedient for the task, and will be readily understood by one skilled in the art.

Chamber 102 is a semi-sealed container and may embody many different shapes and sizes. FIG. 2 illustrates that chamber 102 comprises both the expansion chamber 110 and the flash freeze chamber 111. The expansion chamber 110 in this specification shall mean the region of the chamber 102 below the ice tray 109. The region above ice tray 109 is the flash freeze chamber 111.

The main purpose of the expansion chamber 110 is to provide the natural engine for pushing out the smoke. Since the present invention does not use fans or other exhaust means in order to inject smoke out of cfgnsfds 100, the expansion chamber 110 must accomplish this function. Expansion chamber 110 works by allowing pressure to build up naturally within expansion chamber 110 thereby forcing smoke and fog out of exhaust duct 108.

The main function of flash freeze chamber 111 is to cool the smoke. The cooling of the smoke accomplishes to main objectives. First, a cold smoke is more apt to lie low over the ground, which is desirable in the entertainment industry. Second, a cold smoke is much slower to rise and dissipate than a warm smoke.

Figure 8:
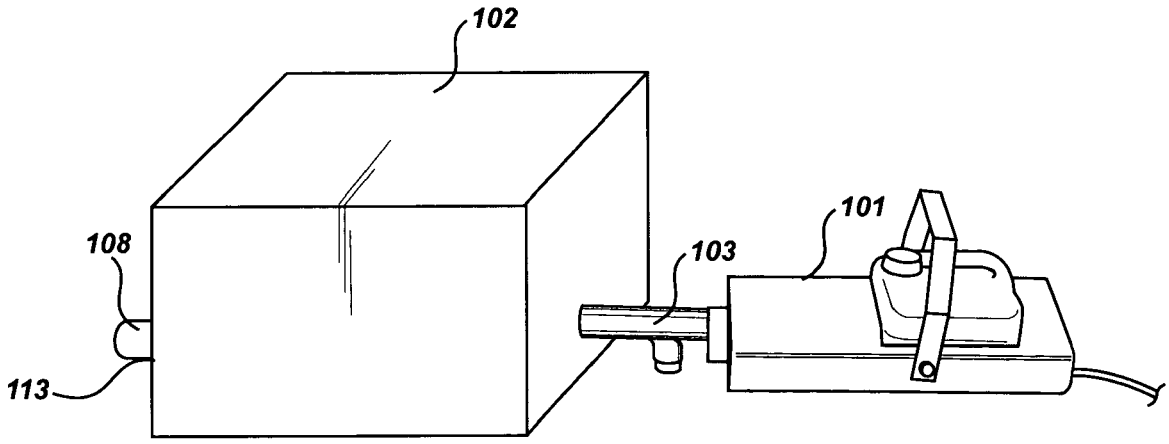
FIG. 8 is an isometric view of a preferred embodiment of the present invention.
Figure 9:
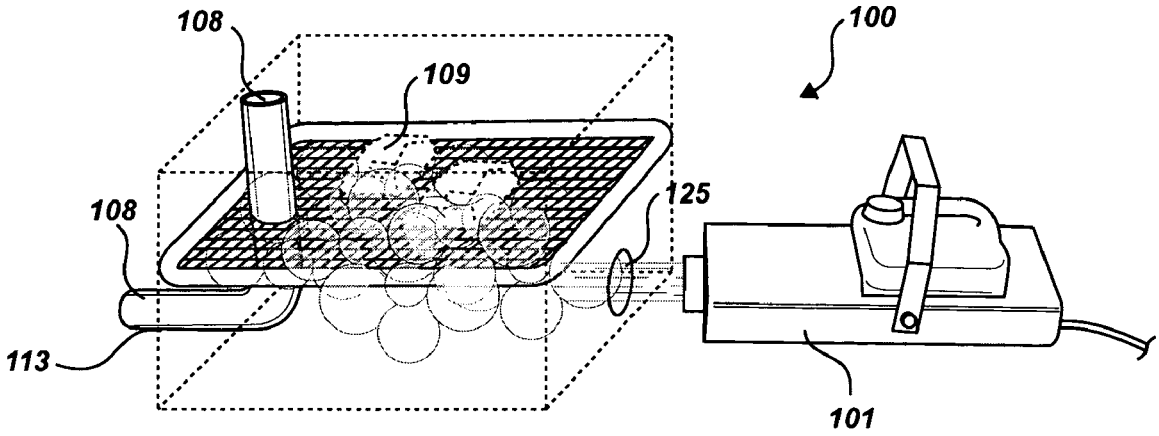
FIG. 9 is an isometric view of a preferred embodiment of the present invention.

FIGS. 8 and 9 illustrates an alternative preferred embodiment of the chamber 102. Chamber's 102 size and shape will be dictated primarily by factors of portability, capacity, and economic factors. Materials used to compose chamber 102 in a preferred embodiment is a plastic material. However, other equally expedient materials may also comprise chamber 102.

Figure 3:
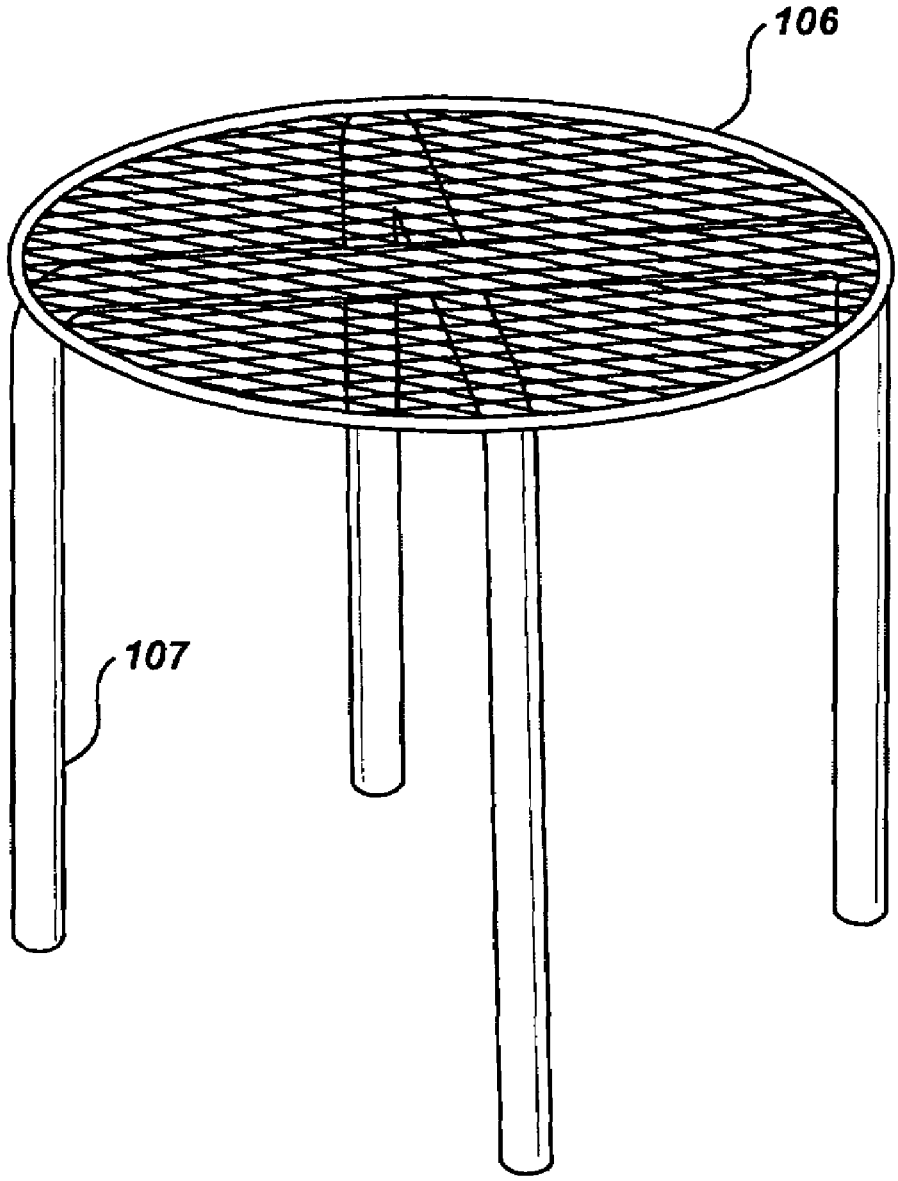
FIG. 3 is an isometric view of a preferred embodiment of the present invention.
Figure 4:
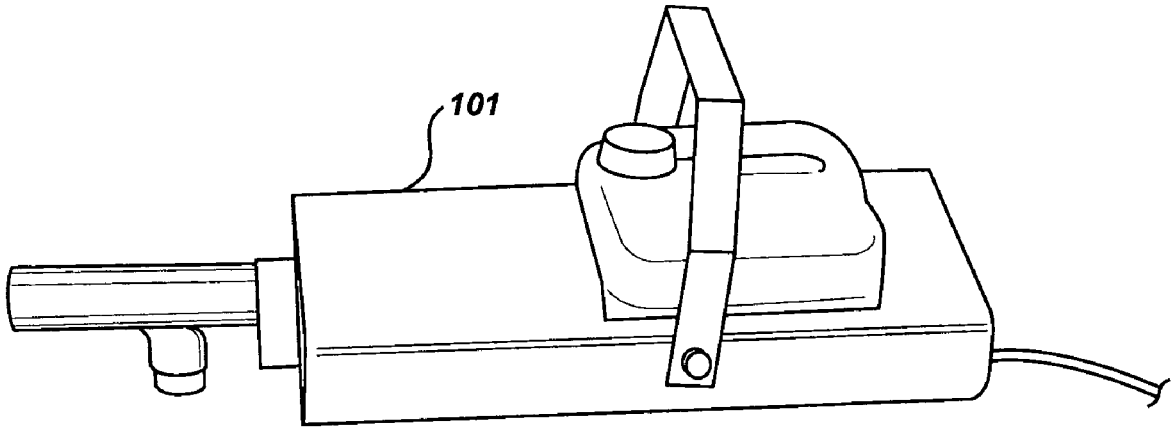
FIG. 4 is an isometric view of a preferred embodiment of the present invention.

Located in chamber 102 is the support apparatus 107 as seen in FIGS. 2 and 3. Support apparatus 107 is used for supporting ice tray 106 and ice 109. Although support apparatus 107 in a preferred embodiment is made of PVC piping material, other equally expedient means for supporting ice tray 106 and ice 109 abound. For instance, flanges may be affixed to the inside walls of chamber 102 to support both ice 109 and ice tray 106. In other preferred embodiments ice tray 106 may be affixed to walls of chamber 102 by soldering, glue, additional orifices in chamber 102, etc. The number of alternative embodiments for support apparatus 107 are endless. Therefore, the specific means for support apparatus 107 is of no consequence to the present invention.

Ice tray 106 consists of a grill-like article of manufacture. Ice tray 106 supports ice 109. Ice tray 106 may embody a panoply of different shapes and sizes. In a preferred embodiment, ice tray 106 is made of a lightweight metal. However, in other preferred embodiments, ice tray 106 may be made of plastic or other suitable material. In addition, ice tray 106 may also be a net of flexible material. The possibilities are endless. Thus, the specific means by which the ice 109 is supported is of no consequence.

Figure 10:
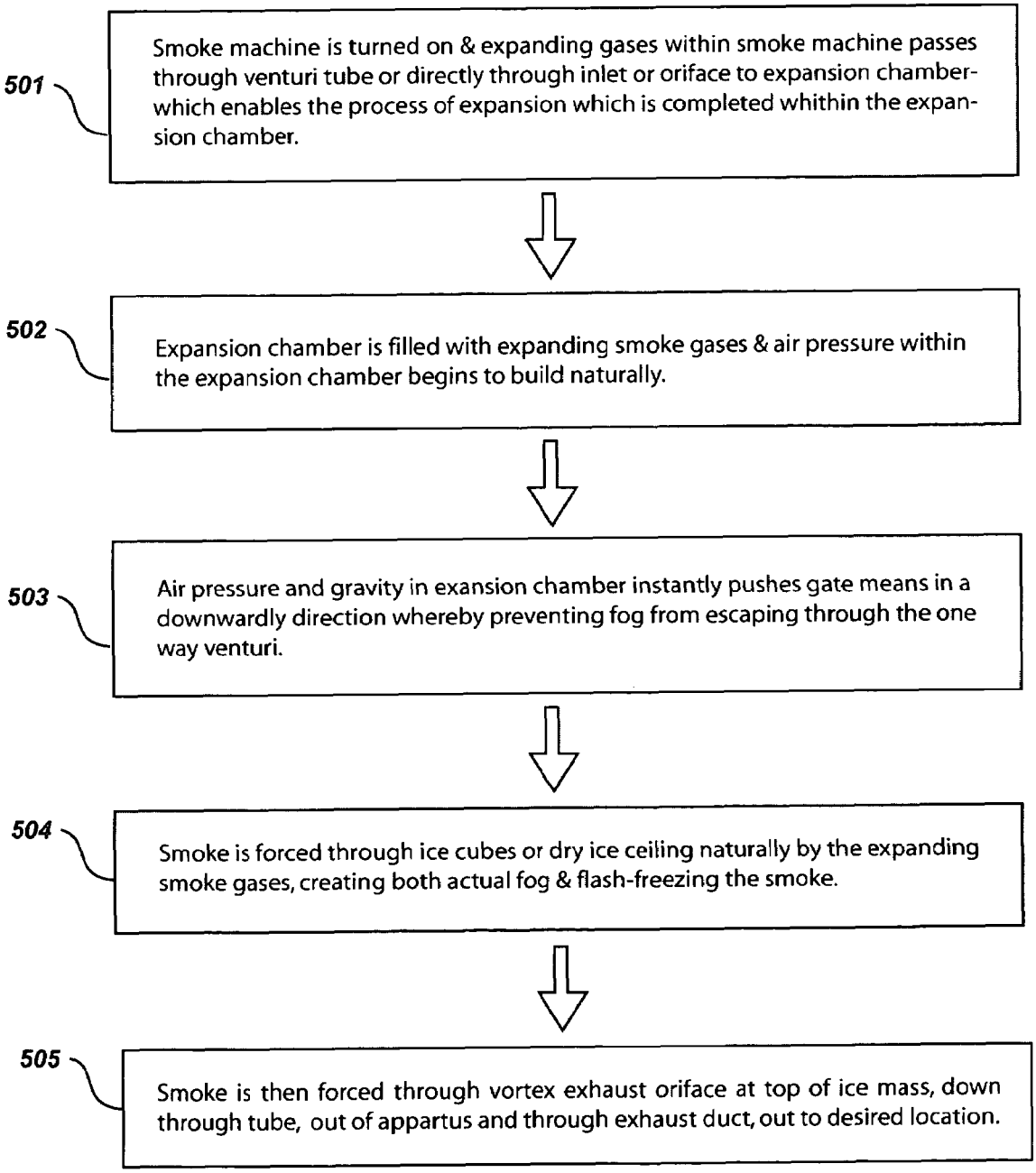
FIG. 10 is a flow diagram illustrating a preferred embodiment of the present invention.

FIG. 10 illustrates a preferred method to be used in conjunction with the present invention. In step one 501, smoke machine 101 is turned on and the expanding gases within smoke machine 101 passes through venturi apparatus 103 or inlet orifice 125 which enables the process of expansion which is completed within expansion chamber 102. This step facilitates the expansion of smoke within the pressure chamber 110. In step two 502, expansion chamber 102 is filled with expanding smoke gases and air pressure within the expansion chamber 110 begins to build naturally. In step three, 503 air pressure in expansion chamber 110 instantly pushes gate means 209 in a downwardly direction thereby preventing smoke from escaping through the one-way venturi 103 (in embodiments which utilize the one way venturi 103). This step also facilitates the expansion of the smoke within the expansion chamber 110. This step also harnesses natural pressure from expanding smoke gases inside the expansion chamber 110 which is the main engine in forcing smoke out of the expansion chamber 110. In step four 504, smoke is forced through ice cubes or dry ice ceiling naturally by the expanding smoke gases, creating both actual fog and flash freezing the smoke. Eventually these natural forces result in fog and smoke to find its way out of cfgnsfds 100 via vortex orifice and out from the exhaust duct 108.

It will be apparent to the skilled artisan that there are numerous changes that may be made in embodiments described herein without departing from the spirit and scope of the invention. For instance, instead of using regular ice or dry ice to cool the smoke or fog, a refrigerator or other cooling means may be used to cool the fog. The ways of cooling the fog are endless. As such, the invention taught herein by specific examples is limited only by the scope of the claims that follow.

What is claimed is:

1. A cold fog generator and smoke/fog distribution system comprising:

a semi-sealed chamber with three orifices, an exhaust duct, water drain tubing, an ice tray, a support apparatus, ice or dry ice, a smoke producing machine and a sealed expansion chamber, said exhaust duct located within said sealed expansion chamber extending from near top of said semi sealed expansion chamber in a downwardly direction and protruding out of said semi sealed expansion chamber through said orifice near a bottom of said semi sealed expansion chamber, said exhaust duct being affixed to said orifice on tower portion of said semi sealed expansion chamber, said exhaust duct extending from said orifice up to and above said support apparatus, said ice tray, and said ice, said ice tray being supported by said support apparatus, and said ice being supported by said ice tray, said water drain tubing located outside of said semi sealed expansion chamber and being connected with one of said orifices, said smoke producing machine introducing smoke into said semi sealed expansion chamber via said inlet orifice.

2. The cold fog generator and smoke/fog distribution system of claim 1 wherein said exhaust duct is made of PVC material.

3. The cold fog generator and smoke/fog distribution system of claim 1 wherein said water drain tubing is made of a plastic material.

4. The cold fog generator and smoke/fog distribution system of claim 1 wherein said ice tray is made of metal.

5. The cold fog generator and smoke/fog distribution system of claim 1 wherein said support apparatus is comprised of four vertically placed support members spaced equidistantly from each other and connected to each other in the center.

6. The cold fog generator and smoke/fog distribution system of claim 5 wherein said support apparatus is made of PVC.

7. The cold fog generator and smoke/fog distribution system of claim 5 wherein said support apparatus is made of metal.

8. The cold fog generator and smoke/fog distribution system of claim 1 wherein said ice tray is made of wire netting.

9. The cold fog generator and smoke/fog distribution system of claim 1 wherein said semi seated expansion chamber is made of plastic.

10. The cold fog generator and smoke/fog distribution system of claim 1 wherein said semi sealed expansion chamber is made of metal.

11. The cold fog generator and smoke/fog distribution system of claim 1 wherein said exhaust duct is in two pieces, lower piece being affixed to upper piece via gluing or threading.

12. The cold fog generator and smoke/fog distribution system of claim 1 wherein said exhaust duct is made of PVC material.

13. The cold fog generator and smoke/fog distribution system of claim 1 wherein said ice tray is made of metal.

14. The cold fog generator and smoke/fog distribution system of claim 2 wherein said ice tray is made of wire netting.

15. The cold fog generator and smoke/fog distribution system of claim 2 wherein said sealed expansion chamber is made of plastic.

16. The cold fog generator and smoke/fog distribution system of claim 2 wherein said semi sealed expansion chamber is made of metal.

17. The cold fog generator and smoke/fog distribution system of claim 2 wherein said support apparatus is comprised of four vertically placed support members spaced equidistantiy from each other and connected with four horizontal members, said four horizontal members being connected to each other in the center.

* * * * *